US006902014B1

(12) United States Patent
Estes

(10) Patent No.: US 6,902,014 B1
(45) Date of Patent: Jun. 7, 2005

(54) ROLLER CONE BI-CENTER BIT

(75) Inventor: Roy D. Estes, Weatherford, TX (US)

(73) Assignee: Rock Bit L.P., Fort Worth, TX (US)

( * ) Notice: Subject to any disclaimer, the term of this patent is extended or adjusted under 35 U.S.C. 154(b) by 0 days.

(21) Appl. No.: 10/210,806

(22) Filed: Aug. 1, 2002

(51) Int. Cl.[7] ..... E21B 10/28

(52) U.S. Cl. ..... 175/266; 175/335; 175/353; 175/391

(58) Field of Search ..... 175/258, 266, 175/334, 335, 350, 353, 376, 385, 391, 398

(56) References Cited

U.S. PATENT DOCUMENTS

| | | | | | |
|---|---|---|---|---|---|
| 2,330,083 | A | * | 9/1943 | Sewell | 175/258 |
| 2,754,090 | A | * | 7/1956 | Kammerer | 175/266 |
| 4,915,181 | A | * | 4/1990 | Labrosse | 175/334 |
| 5,979,574 | A | | 11/1999 | Osadchuk | |
| 6,298,929 | B1 | | 10/2001 | Cobos Rojas | |
| 6,729,418 | B2 | * | 5/2004 | Slaughter et al. | 175/385 |

OTHER PUBLICATIONS

Sketch with cover letter, dated Oct. 6, 1998, showing a "Bi–Center Bit Concept" and disclosed to a prospective customer of the Assignee of the present invention.

* cited by examiner

*Primary Examiner*—David Bagnell
*Assistant Examiner*—Matthew J. Smith
(74) *Attorney, Agent, or Firm*—Law Office of Tim Cook P.C.

(57) ABSTRACT

A roller cone bi-center bit for economically drilling an enlarged borehole below casing in earth formation is provided. The bi-center bit includes a rolling cone cutter or other appropriate cutter to enlarge a pilot bore also made by rolling cone or other type of cutters. The bit comprises a single-diameter body with a recess to accommodate the trailing cutter which enlarges the pilot bore. The bi-center bit may also provide the ability to change out the cutters efficiently in the field. The cutters are oriented to enhance drilling out the cement plug at the bottom of the casing. The cone cutter may be also be mounted on segments which are designed to be easily removed for replacement or adjustment in position in the field.

7 Claims, 7 Drawing Sheets

FIG. 3
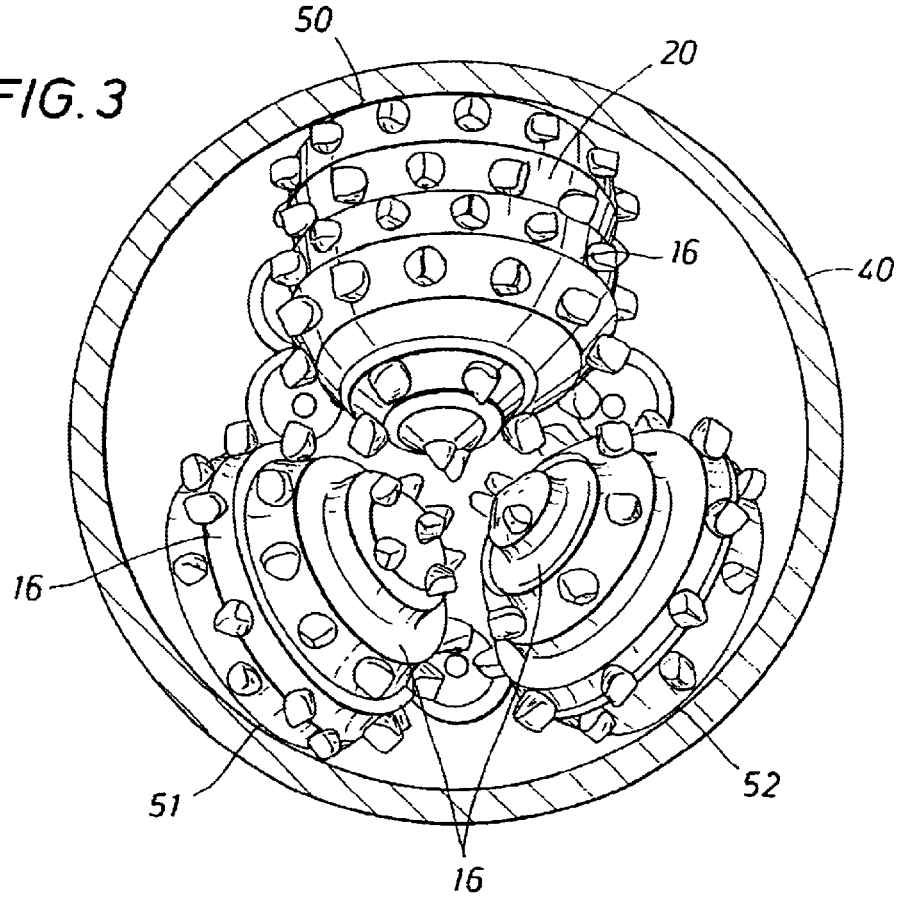
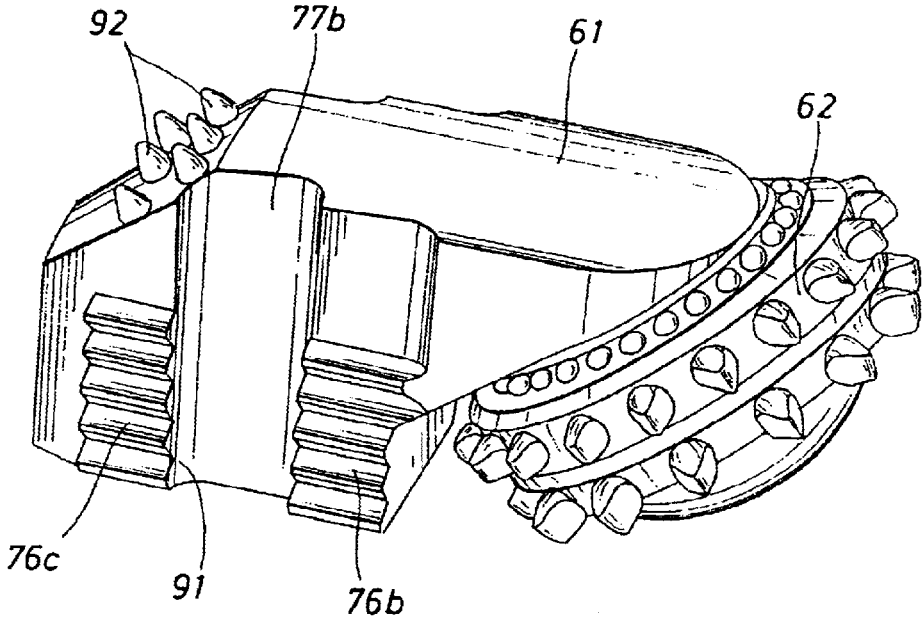
FIG. 6

ROLLER CONE BI-CENTER BIT

This application is related to application Ser. No. 10/209,832, filed simultaneously herewith, and titled Adjustable Earth Boring Device.

BACKGROUND OF THE INVENTION

1. Field of the Invention

The present invention relates generally to the field of earth boring drill bits and, more particularly, to a roller cone bi-center bit for economically drilling an enlarged borehole below casing in very soft to medium earth formations.

2. Description of the Prior Art

Various bi-center bits have been used for years in various oil and gas well drilling operations. A bi-center bit is designed to drill and under-ream at the same time. It is commonly used to pass through a smaller diameter hole and then drill a larger diameter hole in one operation. It has been used in several applications, such as for example deepening or re-entry of existing wells, drilling areas where gage problems occur, increasing an annulus for cementing, prevention of drill pipe sticking, and enlarging the diameter of the borehole through the production zone.

One problem with conventional underreaming bits is the high failure rate of complex articulating mechanisms. Also, conventional bi-center bits typically include costly PDC dependent cutting devices. Further, conventional bi-center bits are not well adapted to common maintenance activities, such as replacing, repairing, or adjusting components in the field.

A typical bi-center bit is shown and described in U.S. Pat. No. 6,298,929 to Cobos Rojas. The '929 patent describes a bi-center drill bit and drill bit assembly including a cylindrical body having a first diameter section and a smaller second diameter section, each section provided with a threaded end. The cylindrical body includes a longitudinal internal channel with a side channel terminating in a sidewall nozzle. Attached to the external surface of the first diameter section is a rotary cone drill bit with the rotary cone positioned in a trailing position from a stream of drilling fluid from the sidewall nozzle. Two stabilizers are mounted to the cylindrical body substantially opposite from the drill bit to stabilize operation of the bit assembly.

While this and similar devices may be suitable for the particular purpose for which they designed, they are not as suitable for economically drilling an enlarged borehole below casing in very soft to medium earth formations. The bi-center bit shown and described in the '929 patent includes a rigidly mounted under-reaming cutting element which enlarges the hole to only one, predefined diameter and is not adjustable. Further, the bi-center bit of the '929 patent includes a rotary cone in a trailing position that extends from an arm entirely outside the larger diameter section of a length of pipe extending to the pilot bit, and is therefore vulnerable to breakage. In these respects, the roller cone bi-center bit according to the present invention substantially departs from the conventional concepts and designs of the prior art, and in so doing provides an adjustable apparatus primarily developed for the purpose of economically drilling an enlarged borehole below casing in very soft to medium earth formations.

SUMMARY OF THE INVENTION

In view of the foregoing disadvantages inherent in the known types of bi-center bits now present in the prior art, the present invention provides a new roller cone bi-center bit construction for economically drilling an enlarged borehole below casing in very soft to medium earth formations. The general purpose of the present invention, which will be described below in greater detail, is to provide a new roller cone bi-center bit that has many of the advantages of the bi-center bits mentioned heretofore and many novel features that result in a new roller cone bi-center bit.

The present invention generally comprises a rolling cone cutter positioned a vertical distance above a tri-cone drill bit to enlarge a pilot bore also made by rolling cone cutters. In one embodiment, the invention provides the ability to change out the cutters efficiently in the field. Further, the cutters are oriented to enhance drilling out the cement plug at the bottom of the casing. The rolling cone cutters are preferably the same type of cutters as are common to tri-cone rock bits. The cone cutters may be mounted on segments which are designed to be easily removed for replacement or adjustment in position in the field. The body is designed to hold the cutting segments in an orientation that enhances the ability to drill out cement plugs.

In order to enhance the profile of the cutting of the reaming bit (i.e. the trailing bit), the body which holds the pilot bit and the reaming bit is formed of a single diameter. To accommodate the reaming bit, a recess is formed into the single diameter body and the reaming bit extends down into the recess to a point below the surface of the body.

There has thus been broadly outlined the more important features of the invention in order that the detailed description thereof may be better understood, and in order that the present contribution to the art may be better appreciated. There are additional features of the invention that will be described hereinafter.

In this respect, before explaining the preferred embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a roller cone bi-center bit that will overcome the shortcomings of known devices. An further object of the present invention is to provide a roller cone bi-center bit for economically drilling an enlarged borehole below casing in very soft to medium earth formations. Another object is to provide a roller cone bi-center bit that will economically drill a larger hole than the casing it passed through in earth formations. Another object is to provide a roller cone bi-center bit that will accomplish the above with a very high rate of reliability. Another object is to provide a roller cone bi-center bit that will accomplish the above and have easily replaceable cutters. Another object is to provide a roller cone bi-center bit that will accomplish the above and can be field adjustable to change hole sizes.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 3 is an end view of a preferred embodiment of a roller cone bi-center bit in a casing.

FIG. 6 is a view of the side cutter of FIG. 4.

DESCRIPTION OF THE PREFERRED EMBODIMENT

Figure 1:
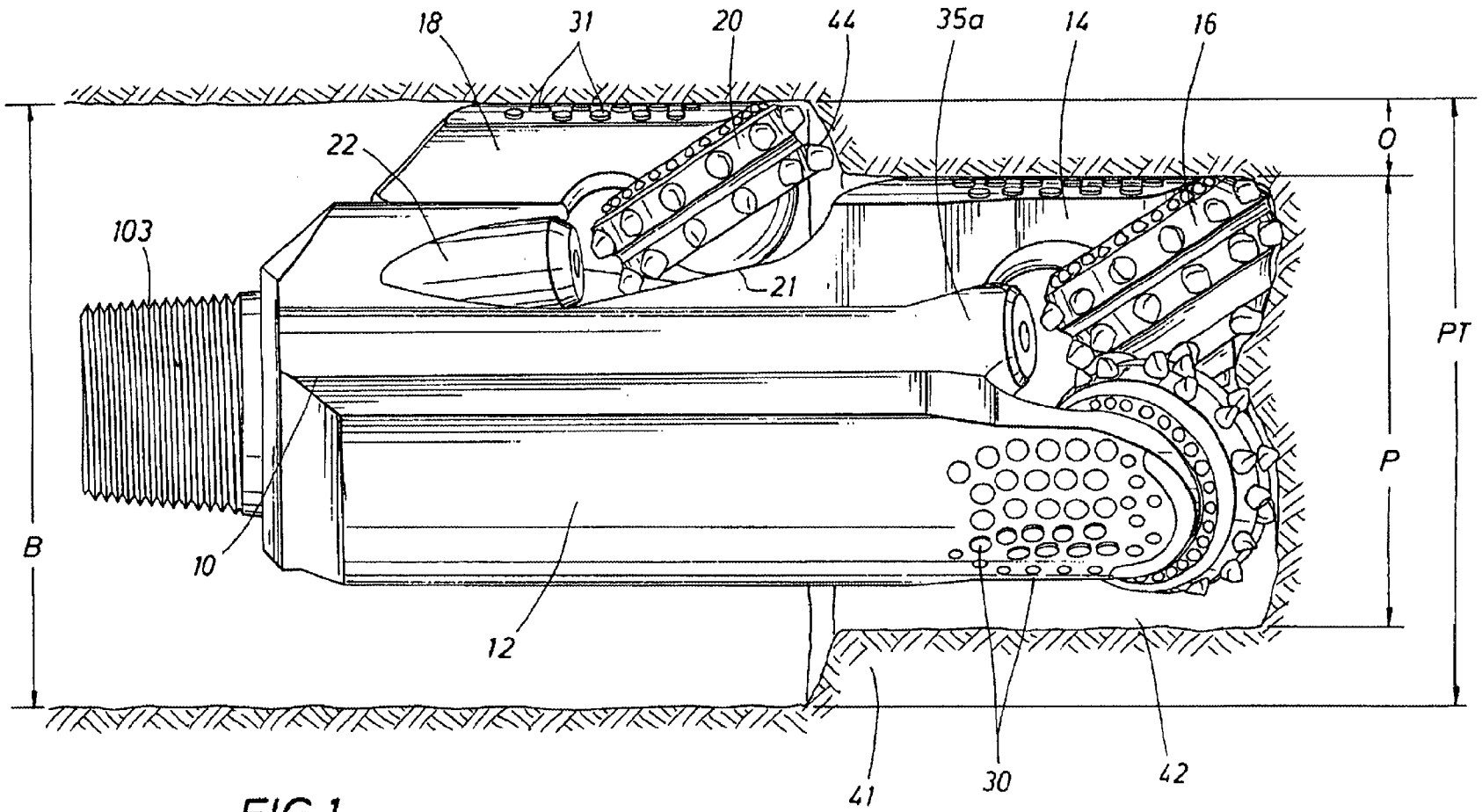
FIG. 1 is a side view of a preferred embodiment of a roller cone bi-center bit in a cut-away borehole.

Turning now to the drawings, in which similar reference characters denote similar elements throughout the several views, the attached figures illustrate a roller cone bi-center bit, which comprises the use of a rolling cone cutter to enlarge a pilot bore also made by rolling cone cutters.

Referring now to FIG. 1, the present invention comprises a rolling cone bi-center bit 10 defining a single-diameter body 12 formed such as by casting and machining in the convention manner. Formed and affixed to the body 12 in the conventional manner are a plurality of pilot cutter segments 14, each such pilot cutter segment retaining a pilot cone cutter 16. Positioned behind the plurality of pilot cutter segments is a side cutter segment 18 which is also formed and affixed to the body 12, extending above the diameter of the body 12. The side cutter segment 18 retains a side cone cutter 20. The side cone cutter 20 extends down into a recess 21 formed into the body 12 a sufficient distance to receive the cutter 20.

As previously noted, the body 12 defines a single diameter with a recess 21 formed therein. To resist wear of the pilot cutter segments 14, a plurality of hardened buttons 30 are provided on the exterior surface of the cutter segments. Similarly a plurality of hardened buttons 31 are provided to resist wear of the side cutter segment 18. The buttons maybe installed in the conventional manner, such as for example by press fit, and may comprise tungsten carbide buttons or the like.

To provide an additional perspective regarding the structure of the bit 10, a diameter P defines a pilot diameter, which is essence defines the gage fo the pilot bit. The side cone cutter 20 extends beyond the pilot diameter by an offset distance 0, and together the pilot diameter P and the offset distance 0 define a pass through diameter PT. The pass through diameter is significant because this is the smallest diameter pipe that the bi-center bit of this invention can traverse, i.e. pass through.

Figure 2:
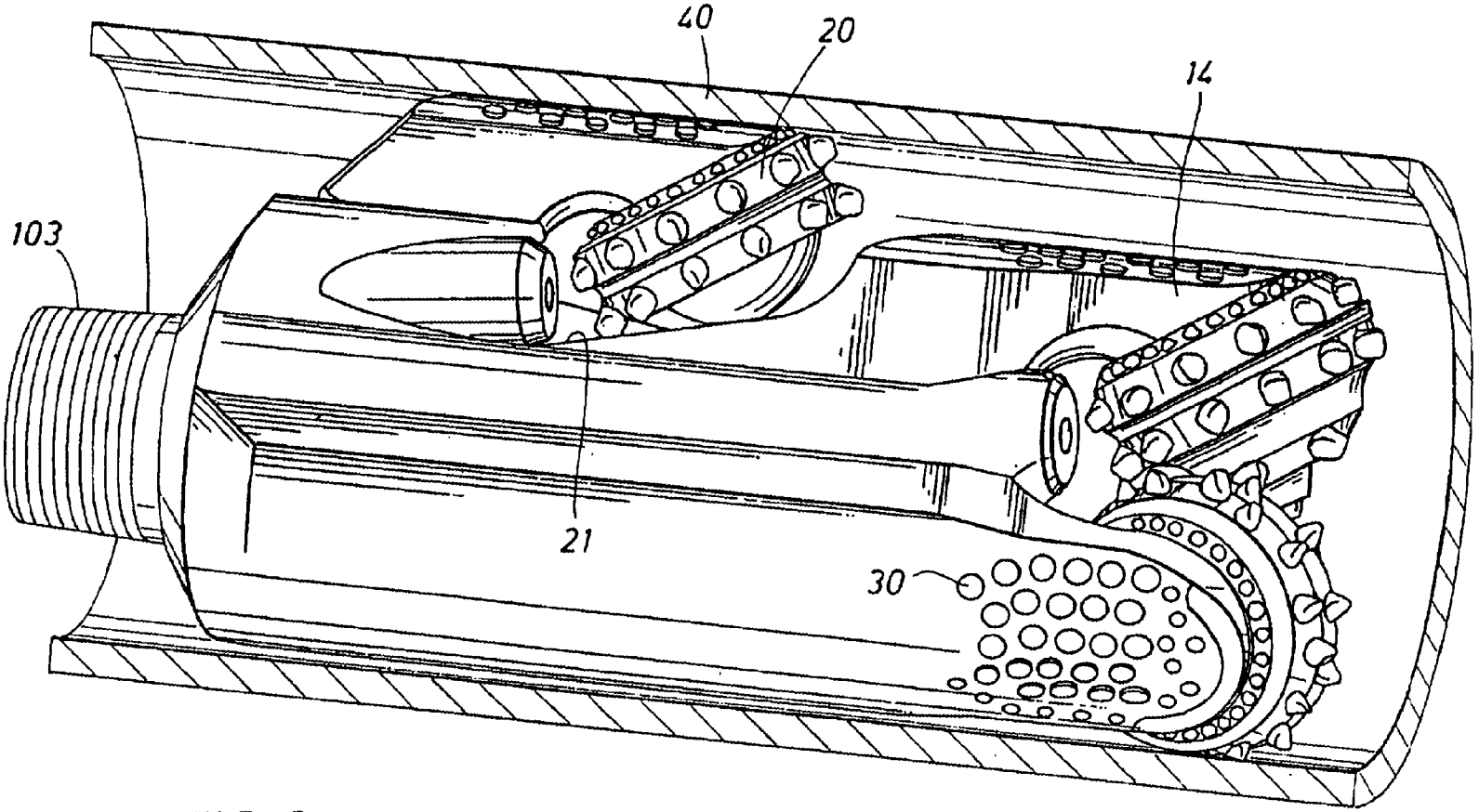
FIG. 2 is a side view of a preferred embodiment of a roller cone bi-center bit in a cut-away casing pipe.
Figure 4:
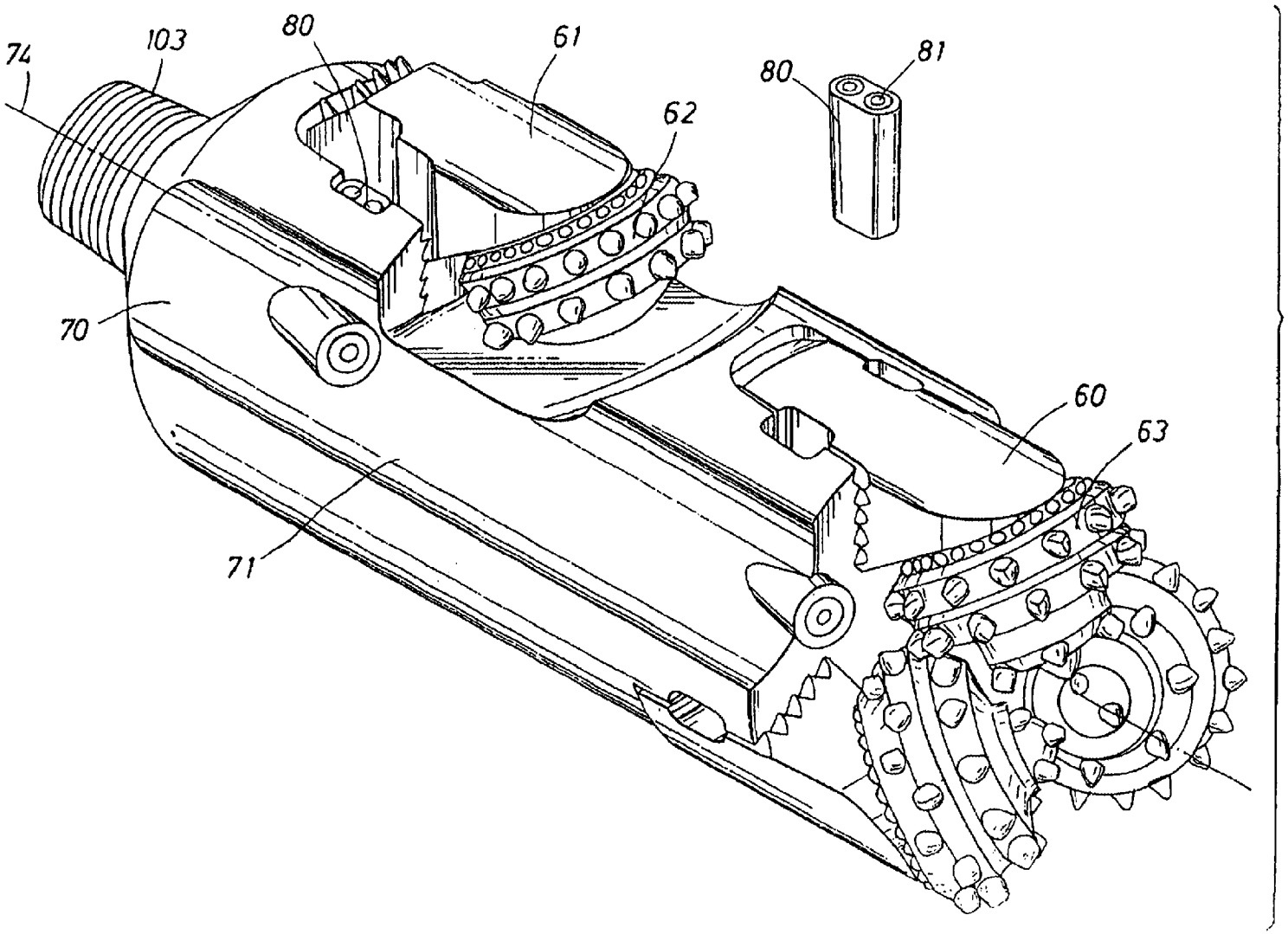
FIG. 4 is an isometric view of an other preferred embodiment of a roller cone bi-center bit.
Figure 5:
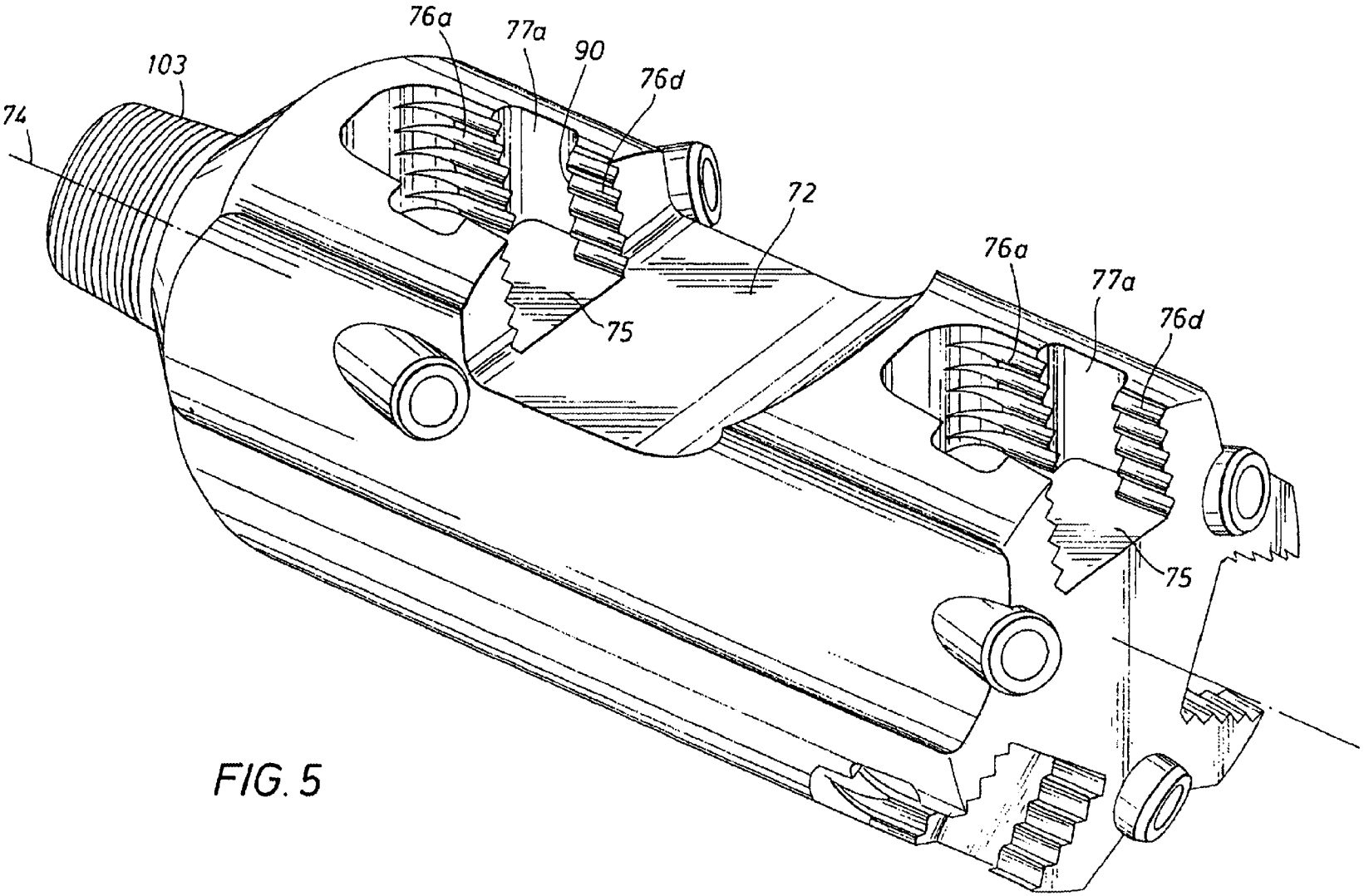
FIG. 5 is an isometric view of the body of the embodiment shown in FIG. 4.

As shown in FIG.2, the bit 10 is sized to pass through the inside diameter of a casing 40 and drill out the cement plug or "shoe" at the bottom of the casing (not shown). It then drills a stepped borehole as shown in formation cut away 41 (FIG. 1). A pilot borehole 42 is cut by the cone cutters 16 and is opened to a full gage borehole diameter B by the side cutter 20. The "pass through" diameter of the bit 10 is therefore equal to the pilot borehole diameter 42 plus the amount the side cutter 20 is offset to the pilot, i.e. the offset O, also shown as a reamed surface 44. A full gage borehole diameter B is equal to the pilot diameter 42 plus twice the offset 44.

Immediately adjacent the side cone cutter 20 is a fluid port 22 to clean the formation ahead of the cutter 20. Similarly, a fluid port 35*a* between pilot cutter segments directs drilling mud onto the borehole face to remove cuttings and cool the cutter. The segments 14 and 18 and their cone cutters 16 and 20 are sealed and have bearing and lubrication systems such as are common to tri-cone rock bits. The fluid ports have replaceable jets common to the art. It should also be apparent to those skilled in the art that the segment 14 and the rolling cone cutters 16 could instead comprises any other appropriate and desired type of cutter.

A feature of the invention is illustrated in FIG. 3, which shows the proper radial orientation of the cutting elements. The offset cutter 20 at a position 50 is radially displaced 120° from two of the pilot cutters 16 at positions 51 and 52. This orientation ensures the widest separation of three points of stabilization of the bit 10 while rotating within casing the 40. It also ensures that two cutters 16 will be used to do most of the cutting of the cement plug mechanism.

The bi-center bit 10 depicted in FIG. 1 is shown as having rectangular segment/pocket design and welded construction as is common to rolling cone core bits. FIGS. 4–7 together illustrate another embodiment of the invention wherein a rolling cutter bi-center bit 70 defines a set of removable and replaceable pilot segments 60 and a removable and replaceable side segment 61, all of which are easily removable from a body 71. A set of complementary pockets 75 (FIG. 5) are formed in the body 71 to receive the segments 60 and 61 which are wedge shaped. Each of the pockets 75 defines a set of matching grooves 76*a* and 76*d* to precisely yet adjustably mate with a set of grooves 76*b* and 76*c*, shown more distinctly in FIG. 6. In operation, as the segment 61 is being mounted within its appropriate pocket 75, the cutter 62 can be placed an adjustable radial distance from a centerline 74 simply by the expedient of selecting which grooves 76*b* and 76*c* are to be mated with which grooves 76*a* and 76*d*. This feature is shown and described in application Ser. No. 10/209,832, filed simultaneously herewith, titled Adjustable Earth Boring Device, and incorporated herein by reference.

Figure 7:
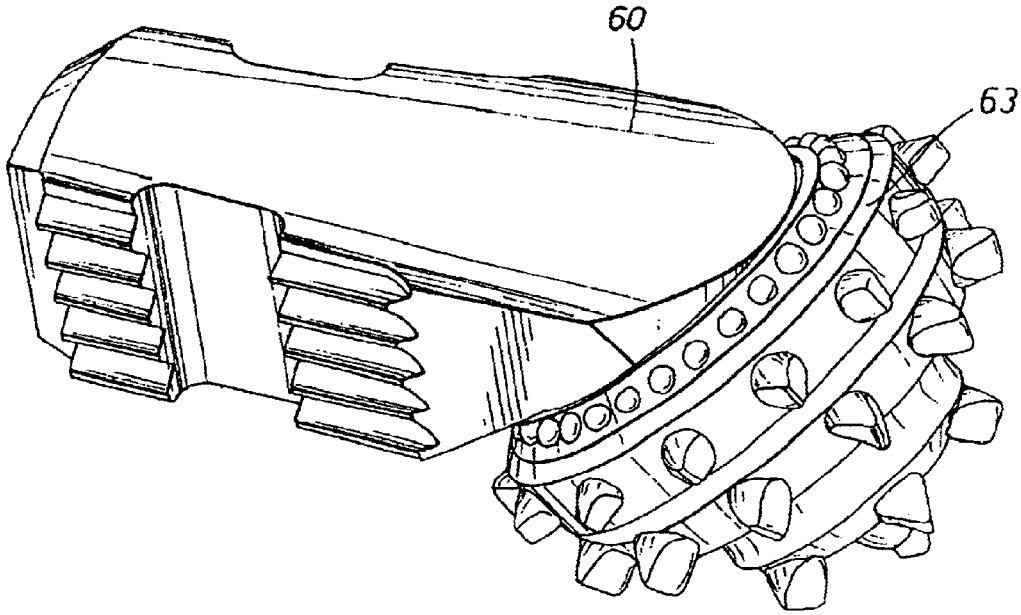
FIG. 7 is a side view of one of the 3 pilot cutters of FIG. 4.

FIG. 6 depicts a preferred structure for a segment 61 and its associated rolling cone cutter 62 and FIG. 7 depicts a preferred structure for a segment 60 and its associated rolling cone cutter 63. In order to retain the segments 60 and 61 within their respective pockets 75, a vertical wedge-shaped recess 77*a* is provided between the grooves 76*a* and 76*d*. Similarly, a vertical wedge-shaped recess 77*b* is provided between the grooves 76*b* and 76*c*, and, when the segments 60 and 61 are properly secured in their respective pockets, the recesses 77*a* and 77*b* line up. A tapered locking wedge 80 is then inserted into the recesses, securing the segments in place. The wedge 80 is then preferably screwed in place in the body 71 with a set of screws 81. One locking wedge 80 is adequate to retain a segment securely in place, but for extra safety two such locking wedges per segment are recommended, one on either side of the respective segment. As the wedge 80 is forced down, it slides against a front edge 90 of the recess 77*a* and a back edge 91 of the recess 77*b* and forces the segment 61 tightly into the wedge shaped pocket 75. Note that an open area 72 in the body 71 for the side cutter 62 is large enough to allow assembly, and is necessarily larger than the recess 21 previously described in respect of FIG. 1. This method of securing the segments onto the body allows the segments to be changed out easily and minimizes the possibility of separation of segments from the body down hole. It is understood that there are other methods that can be used to secure removable segments 60 and 61 to a body such as the body 71.

The ability to adjust heights of the cutters allows the same components to be assembled to pass through different casing ID's and to cut different bore diameters. FIG. 6 also shows back out reaming cutters 92 which may be used on rolling cone coring bits. The reaming cutters 92 are useful in formations that may experience swelling or caving. Back out reaming cutters allow a bit to ream its way back up a damaged bore.

Figure 8:
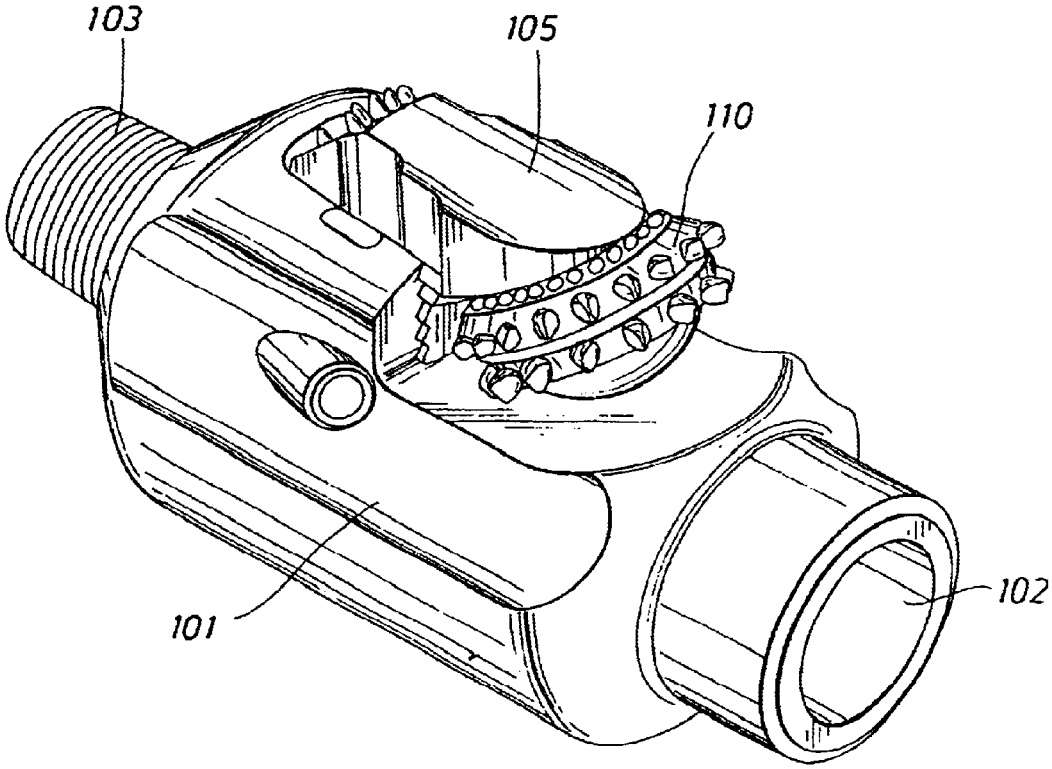
FIG. 8 is a view showing a side cutter mounted on a body to be attached to a standard bit.

FIG. 8 shows a variation of the present invention in which an offset cutter assembly comprises an adjustable cutter segment 105 and its associated rolling cone cutter 110. This assembly is mounted on a body 101 with a rock bit box 102. The body 101 is also appropriately provided with a threaded stem connection 103 for coupling to a drill string in a manner known in the art. This device forms a bi-center bit when a suitable rock bit (not shown) is attached to its lower end as a pilot bit. Proper orientation of the offset cutter to the pilot bit cutters as shown in FIG. 3 is achieved by using one or more spacer washers (not shown) between the body 101 and the pilot bit. Some applications may require a longer stem at the box end to allow grip area for tongs for assembly and disassembly. Other applications may require a fishing neck and/or tong area between the pin and main portion of the body 101. Fishing necks may also be added to the bits shown in FIGS. 1 and 4. The grooves allow changes in the pass through diameter and the finished bore diameter.

Figure 9B:
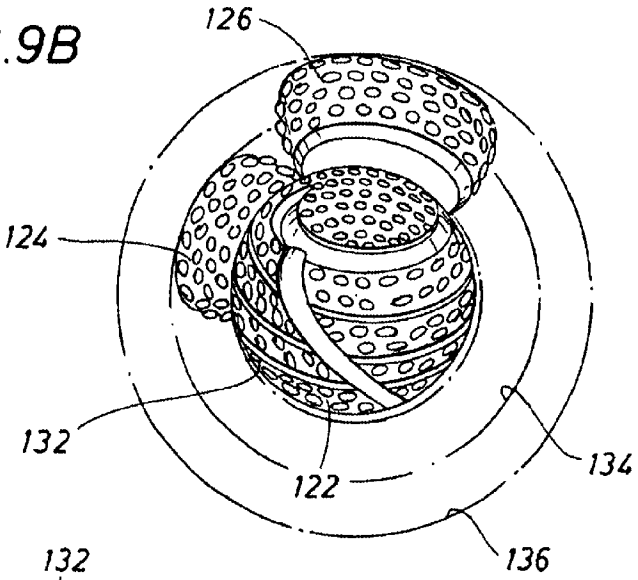
FIGS. 9*a* and 9*b* depict an alternative embodiment of the invention including two stepped reaming bits and a single roller pilot bit.
Figure 9A:
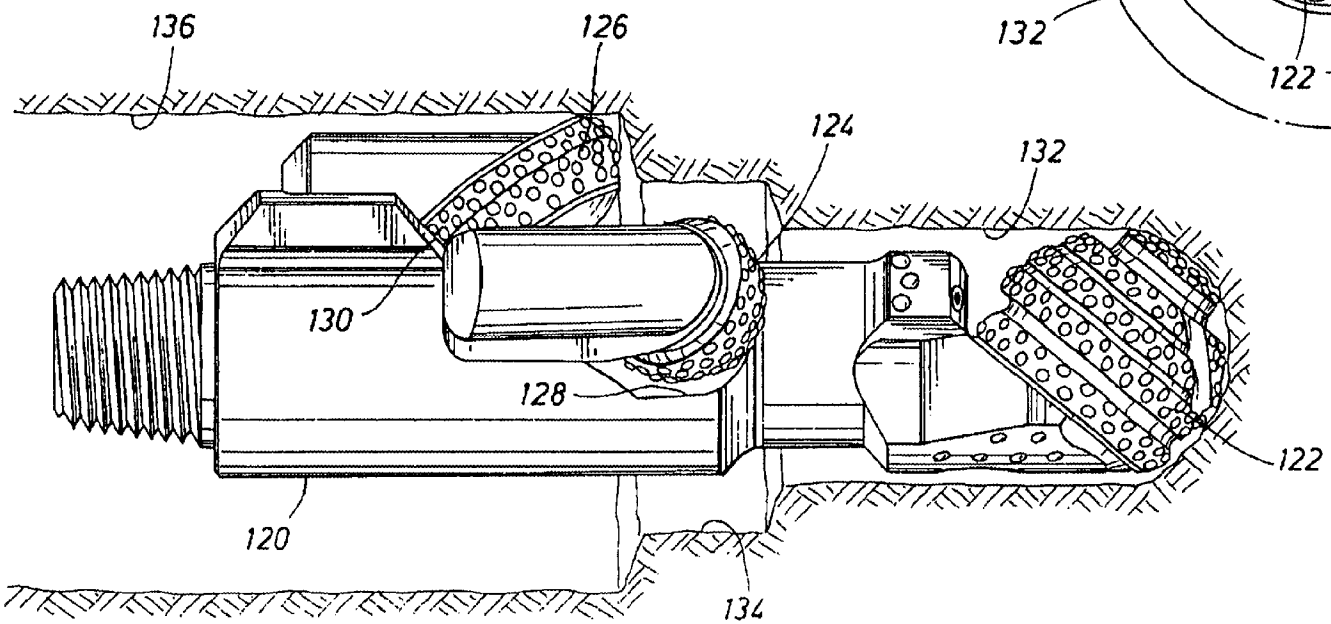

Finally, FIGS. 9*a* and 9*b* depicts another preferred embodiment of the invention, further including another reaming bit. The embodiment illustrated in FIG. 9 also illustrates that the bits shown in the previously described drawings are not the only bits that may be used in carrying out the present invention. The bi-center bit shown in FIG. 9 comprises a body 120 on which are mounted a single pilot bit 122, a first reaming bit 124 placed a distance above the pilot bit 122, and a second reaming bit 126, placed a distance above the first reaming bit. The first reaming bit 124 is mounted to the body and extends into a recess 128, and the second reaming bit is mounted to the body and extends into a recess 130. The pilot bit 122 drills a pilot bore 132, while the first reaming bit enlarges the pilot bore to an intermediate diameter 134 and the second reaming bit enlarges the first diameter 134 to a final diameter 136.

FIG. 9*b* illustrates an advantage of the structure depicted in FIG. 9*a*. Each of the pilot bit 122, the first reaming bit 124, and the second reaming bit 126 is radially displaced from the other two bits. In this way, the torque created by each of the bits is roughly distributed around the circumference of the bit combination, thereby present a balanced force during drilling and lessening the likelihood of an imbalance. Permits the pilot bit to drill out the cement plug and shoe.

In summary, the present invention provides a bi-center bit wherein the cone cutters are mounted on segments which are designed to be easily removed for replacement or adjustment in position in the field. Grooved and wedge shaped segments fit securely into matching pockets. The present invention further provides a single-diameter bi-center bit wherein a trailing bit is recessed into the body of the bit for a clean, stable cut. In this way, the body holds the cutting segments in an orientation that enhances the ability to drill out cement plugs. Three point stabilization allows the bit to rotate in the casing with less vibration. Placing the side cutting element opposite two of the pilot cutters insures that two cutters will be used to drill out the cement and shoe.

A rolling cone bi-center bit as described herein is attached to a rotary drill string of a drilling rig and lowered through the casing to the beginning of the cement plug. It is rotated to drill out the cement and cementing shoe (plug and valve mechanism). While rotating in the casing the bit is stabilized by the three points of contact. Upon drilling into earth formation, the bit stabilizes and rotates around the axis or centerline of the bit. The pilot cutters and the outer surfaces of their segments force the bit rotation to stabilize on that centerline. Because of the importance of this stabilization to the function of the bit, the outer surfaces of the pilot segments will normally be heavily protected with tungsten carbide inserts. In some applications, the length of the stabilizing surfaces of the pilot portion of the bit may be extended. As the proportional difference between the pass through diameter and the final bore diameter increases, there is more need for increasing the stabilizing surfaces. As the offset distance increases, the off-center loading of the bit increases and more stabilizing force is required.

It is to be realized that the optimum dimensional relationships for the parts of the invention, to include variations in size, materials, shape, form, function and manner of operation, assembly and use, will be readily apparent to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An offset cutter assembly comprising:

a. an elongate, axially aligned body defining an outer cylindrical body having a pocket, the body further defining a first threaded connection at one end thereof and a second threaded connection at the other end thereof;

b. a field-replaceable, rigidly mounted reaming bit segment having a roller cone cutter rotatably mounted thereon, the reaming bit segment extending radially into the pocket;

c. a wedge shaped recess defined by the body and the segment; and d. a tapered locking wedge adapted to slide into the wedge shaped recess to rigidly and field-replaceably mount the segment to the body.

2. The earth boring bit of claim 1, wherein the reaming bit segment is removable from the body.

3. The earth boring bit of claim 1, wherein the reaming bit segment is adjustable to define a variable earth boring diameter.

4. The earth boring bit of claim 1, further comprising a plurality of wear buttons on the reaming bit segment.

5. An offset cutter assembly comprising:

a. an elongate, axially aligned body defining an outer cylindrical body having a pocket, the body further defining a box at a lower end thereof and a threaded stem connection at an upper end thereof;

b. a field-replaceable, rigidly mounted reaming bit segment having a roller cone cutter rotatably mounted thereon, the reaming bit segment positioned above the box and extending radially into the pocket; and c. a plurality of parallel grooves on the body and a mating plurality of parallel grooves on the segment for mounting the segment on the body.

6. The earth boring bit of claim 5, wherein the plurality of parallel grooves on the body are parallel to the axis of the body.

7. The earth boring bit of claim 5, wherein the plurality of parallel grooves on the body and the mating plurality of parallel grooves on the segment define wedging surfaces.

* * * * *